US006142750A

United States Patent [19]

Benecke

[11] Patent Number: 6,142,750

[45] Date of Patent: Nov. 7, 2000

[54] GEAR PUMP AND REPLACEABLE RESERVOIR FOR A FLUID SPRAYER

[75] Inventor: Arnold George Benecke, Indian Springs, Ohio

[73] Assignee: The Procter & Gamble Company, Cincinnati, Ohio

[21] Appl. No.: 09/201,618

[22] Filed: Nov. 30, 1998

[51] Int. Cl.[7] ..... F04B 35/04; F04B 17/00

[52] U.S. Cl. ..... 417/411; 417/46; 222/383

[58] Field of Search ..... 417/411, 45, 234, 417/46, 390, 199; 222/259, 318, 333, 383; 184/105.1; 239/3, 332, 1, 127, 135

[56] References Cited

U.S. PATENT DOCUMENTS

| | | | |
|---|---|---|---|
| Re. 21,699 | 1/1941 | Monnier | 215/37 |
| D. 396,908 | 8/1998 | Beechuk et al. | D32/45 |
| D. 401,703 | 11/1998 | Beechuk et al. | D32/45 |
| 1,241,352 | 9/1917 | Doering et al. . | |
| 1,319,376 | 10/1919 | Cooper . | |
| 1,337,206 | 4/1920 | Doering et al. . | |
| 1,715,632 | 6/1929 | Wertheimer . | |
| 2,053,282 | 9/1936 | Gewalt . | |
| 2,137,944 | 11/1938 | MacLeod . | |
| 2,187,671 | 1/1940 | Suddarth . | |
| 2,470,837 | 5/1949 | Polson . | |
| 2,618,799 | 11/1952 | Barbato . | |
| 2,842,276 | 7/1958 | Butler | 215/79 |
| 3,011,722 | 12/1961 | Federichi et al. | 239/61 |
| 3,055,367 | 9/1962 | Thorstad | 128/272 |
| 3,085,601 | 4/1963 | Zellweger | 141/293 |
| 3,092,106 | 6/1963 | Butler | 128/214 |
| 3,094,152 | 6/1963 | Kenny et al. . | |
| 3,099,028 | 7/1963 | Ardito . | |
| 3,131,712 | 5/1964 | Risley et al. | 137/318 |
| 3,166,096 | 1/1965 | Lang | 137/564.5 |
| 3,188,669 | 6/1965 | Beardslee . | |
| 3,200,994 | 8/1965 | Levinson et al. | 222/82 |
| 3,278,974 | 10/1966 | Nighswander . | |
| 3,392,859 | 7/1968 | Fischer | 215/39 |
| 3,542,240 | 11/1970 | Solowey | 222/83 |
| 3,685,694 | 8/1972 | Ianelli | 222/82 |
| 3,720,489 | 3/1973 | Raper | 418/45 |
| 3,826,408 | 7/1974 | Berndt et al. | 222/70 |

(List continued on next page.)

FOREIGN PATENT DOCUMENTS

| | | | |
|---|---|---|---|
| 746231 | 11/1966 | Canada . | |
| 65044 | 1/1990 | Canada . | |
| 1 269 210 | 5/1990 | Canada | 15/8 |
| 82685 | 12/1997 | Canada . | |
| 2225303 | 6/1998 | Canada . | |
| 0365770 | 5/1990 | European Pat. Off. . | |
| 1031533 | 6/1958 | Germany . | |
| 3439388 | 4/1986 | Germany . | |
| WO95/32059 | 11/1995 | WIPO . | |

*Primary Examiner*—Teresa Walberg
*Assistant Examiner*—Leonid Fastovsky
*Attorney, Agent, or Firm*—Elizabeth M. Koch; James C. Vago

[57] ABSTRACT

A gear pump and reservoir device for a fluid sprayer comprises a pump housing having a recessed portion for receiving and sealing thereto a fluid reservoir and a cavity for locating a drive motor and gears therein. The recessed portion has a rigid conical projection centered therein which has an orifice extending into a pump inlet. The gear pump further includes a fluid container mounted above the recessed portion of the pump housing to form a fluid reservoir. The fluid reservoir has a discharge valve that is opened by engagement with the conical projection within the recessed portion to provide fluid communication to the pump inlet. A static head in the fluid reservoir maintains the gear pump in a primed state. A fluid line leading from the gear pump to a sprayer head has a discharge check valve located therein. The check valve has a cracking pressure higher than the static head of fluid so that fluid passes to the sprayer head only when the gear pump operates to increase pressure in the fluid line above the cracking pressure. There is also means for powering and operating the motor such that the gear pump provides a continuous flow of fluid to the sprayer head upon demand by a user.

14 Claims, 3 Drawing Sheets

U.S. PATENT DOCUMENTS

| | | | |
|---|---|---|---|
| 3,953,902 | 5/1976 | Taylor | 4/227 |
| 3,993,250 | 11/1976 | Shure | 239/332 |
| 3,995,772 | 12/1976 | Liautaud | 222/83.5 |
| 4,004,862 | 1/1977 | Hill et al. | 417/234 |
| 4,030,857 | 6/1977 | Smith, Jr. | 417/46 |
| 4,079,865 | 3/1978 | Kutik | 222/259 |
| 4,109,832 | 8/1978 | Kutik et al. | 222/318 |
| 4,119,386 | 10/1978 | Cushing | 401/138 |
| 4,163,500 | 8/1979 | Gunne et al. | 215/260 |
| 4,173,295 | 11/1979 | Steinman | 222/81 |
| 4,209,488 | 6/1980 | Breno | 422/101 |
| 4,243,150 | 1/1981 | Gunne et al. | 215/247 |
| 4,481,986 | 11/1984 | Meyers | 141/4 |
| 4,506,807 | 3/1985 | Anderson | 222/181 |
| 4,572,397 | 2/1986 | Arens | 220/270 |
| 4,580,721 | 4/1986 | Coffee et al. | 239/3 |
| 4,624,627 | 11/1986 | Tunks | 417/199 A |
| 4,699,188 | 10/1987 | Baker et al. | 141/18 |
| 4,728,006 | 3/1988 | Drobish et al. | 222/181 |
| 4,747,518 | 5/1988 | Laauwe | 222/153 |
| 4,767,033 | 8/1988 | Gemperie | 222/383 |
| 4,770,613 | 9/1988 | Hoover et al. | 417/411 |
| 4,848,659 | 7/1989 | Tadych | 239/127 |
| 4,863,299 | 9/1989 | Osberghaus et al. | 401/15 |
| 4,874,023 | 10/1989 | Ulm | 141/346 |
| 4,921,150 | 5/1990 | Lagergren et al. | 222/639 |
| 4,971,471 | 11/1990 | Sloan | 401/203 |
| 4,987,975 | 1/1991 | Liu | 184/105.1 |
| 5,014,884 | 5/1991 | Wunsch | 222/333 |
| 5,020,220 | 6/1991 | Miyake et al. | 30/2 |
| 5,031,675 | 7/1991 | Lindgren | 141/291 |
| 5,086,950 | 2/1992 | Crossdale et al. | 222/88 |
| 5,092,699 | 3/1992 | Silvenis | 401/21 |
| 5,244,124 | 9/1993 | Raffo | 222/325 |
| 5,388,761 | 2/1995 | Langeman | 239/1 |
| 5,397,034 | 3/1995 | Wunsch | 222/333 |
| 5,472,122 | 12/1995 | Appleby | 222/212 |
| 5,526,963 | 6/1996 | Smith | 222/321.8 |
| 5,636,402 | 6/1997 | Kubo et al. | 15/98 |
| 5,735,959 | 4/1998 | Kubo et al. | 118/663 |
| 5,888,006 | 3/1999 | Ping et al. | 401/137 |

GEAR PUMP AND REPLACEABLE RESERVOIR FOR A FLUID SPRAYER

FIELD OF THE INVENTION

The present invention relates to electrically powered fluid spray systems, and particularly to those spray systems needing non-pulsating sprays. Even more particularly, the present invention relates to fluid sprayers using gear pumps and replaceable fluid reservoirs.

BACKGROUND OF THE INVENTION

Sprayer pumps needing continuous fluid spraying are known to use miniature gear pumps to lift fluid from a reservoir and to develop the necessary pressure to enable a sprayer head to breakup the fluid sufficiently to generate a non-pulsating spray. Priming such pumps may take 10 seconds or more to replace air in a dip tube or delivery line with fluid. Expensive precision parts may be needed to lift a fluid more than a few inches. A check valve to prevent backflow to the reservoir may be needed to prevent losing the prime at the pump.

Fluids having surfactants therein are difficult to contain without leakage. Dribble at a sprayer head is especially undesirable. A check valve is often used immediately upstream of the sprayer head to minimize fluid volume available for dribble at the sprayer head outlet. The check valve typically has a cracking pressure or threshold pressure that has to be exceeded before fluid flow to the sprayer head may occur. The combination of suction needed for pump priming and fluid lifting, as well as the discharge cracking pressure, may be too much for an inexpensive gear pump to overcome.

What is needed is a simple gear pump and reservoir combination which minimizes the necessary suction for pump priming and fluid lifting so that a cracking pressure as high as 3.5 psig is exceeded by the pump. In addition, what is needed is a self-priming gear pump that is primed in one or two seconds. Furthermore, what is needed is a replaceable fluid reservoir that may be connected to a gear pump simply, yet in a leak-resistant manner.

SUMMARY OF THE INVENTION

In one preferred embodiment of the present invention, a gear pump and reservoir for a fluid sprayer comprise a motor driven gear pump having a mounting surface for attachment to a hand held appliance and a means for sealing the gear pump to a fluid reservoir. The fluid reservoir is located above the gear pump so that a static head of fluid in the reservoir maintains the gear pump in a primed state.

Also included is a fluid line leading from the gear pump to a sprayer head. The fluid line has a discharge check valve located therein, and the check valve has a cracking pressure higher than the static head of fluid so that fluid passes to the sprayer head only when the gear pump operates to increase pressure in the fluid line above the cracking pressure. The gear pump and reservoir further include means for powering and operating the motor driven gear pump such that the gear pump provides a continuous flow of fluid to the sprayer head upon demand by a user.

In another preferred embodiment of the present invention, a gear pump and reservoir for a fluid sprayer comprise a pump housing having a mounting surface for attachment to a hand held appliance and a recessed portion for receiving and sealing to a fluid reservoir. The pump housing also has a cavity for locating a drive motor and gears therein. The cavity has ribs therein forming pump passages including a pump inlet and a pump outlet. The recessed portion has a rigid conical projection centered therein which has an orifice extending into the pump inlet. The gear pump also includes an electric motor having a motor housing and a rotating shaft extending from the motor housing. The motor housing is connected to the pump housing via a resilient fluid sealing member. In addition, the gear pump includes a pinion gear mounted to the rotating shaft of the motor inside the cavity of the pump housing, and an idler gear rotatably connected within the cavity to engage the pinion gear. The gears, together with the pump passages in the cavity, substantially limit fluid backflow between mating gear teeth of the gears, and between gear teeth and pump walls, to form a gear pump. The pump outlet is in fluid communication with the gear pump and has a fluid line leading from the pump outlet to a sprayer head. The fluid line has a discharge check valve to minimize fluid dribbling at the sprayer head. The check valve has a cracking pressure. The gear pump further includes a fluid container mounted to the recessed portion of the pump housing to form a fluid reservoir. The container has an air vent valve to enable ambient air to replace fluid drawn from the reservoir and a fluid discharge valve. The fluid discharge valve is opened by engagement with the conical projection within the recessed portion to provide fluid communication to the pump inlet. The gear pump additionally includes means for powering and operating the motor such that the gear pump provides a continuous flow of fluid to the sprayer head upon demand by a user.

DETAILED DESCRIPTION OF THE INVENTION

Figure 1:
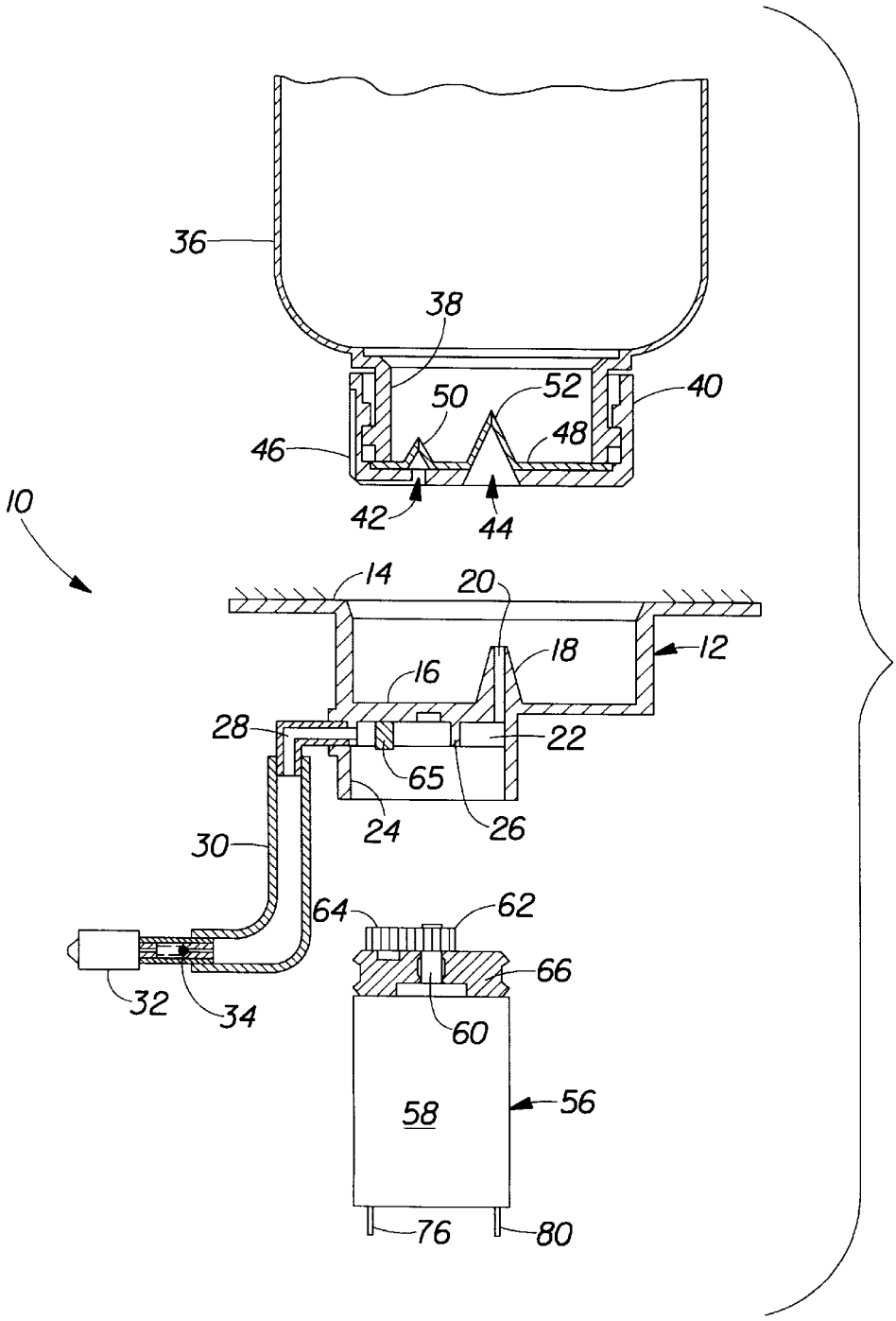
FIG. 1 is an exploded cross-sectional view of a preferred embodiment of the gear pump and reservoir for a fluid sprayer of the present invention, disclosing a portion of an inverted container having a fitment closure and valving, a pump housing having a mounting surface and being flexibly connected to a sprayer head, and a pump motor having a fluid sealing member and two gears.
Figure 2:
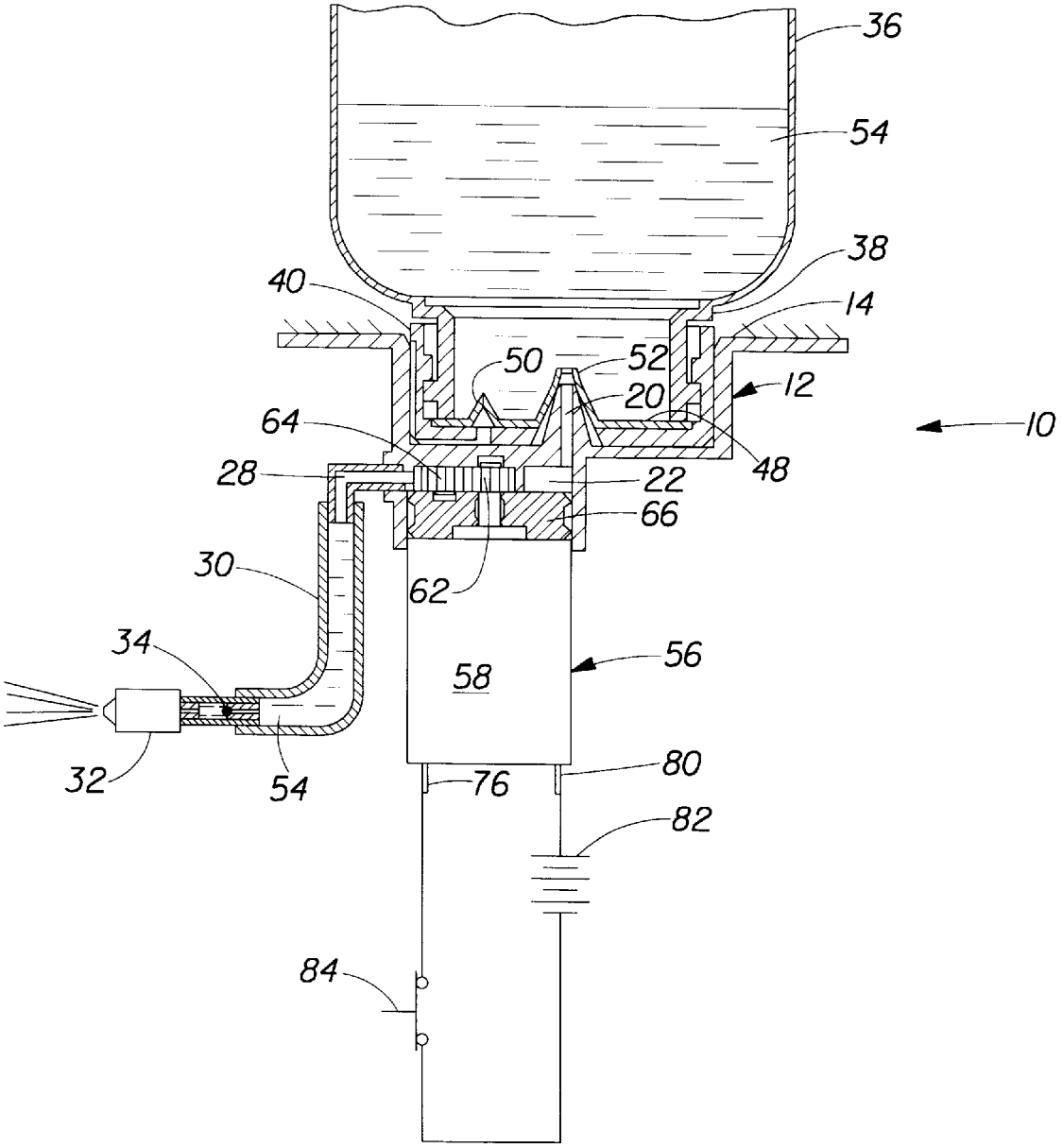
FIG. 2 is a cross-sectional view showing the assembly of the components of FIG. 1 and a schematic representation of batteries and a closed switch in series for operating the gear pump to spray fluid from the inverted container through the sprayer head.
Figure 3:
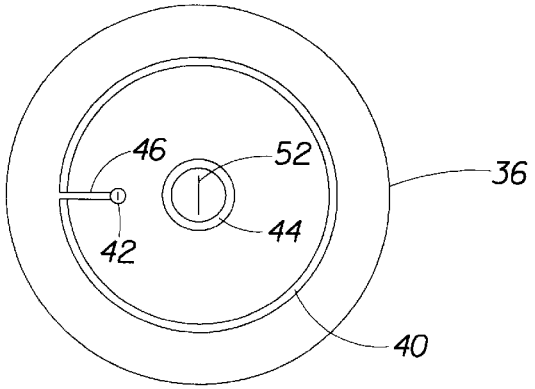
FIG. 3 is a bottom view of the inverted container with the fitment and valving of FIG. 1, showing a normally closed slit valve in the center of the fitment, which prevents fluid escaping from the container.

Referring to FIGS. 1 and 2, there is shown a first preferred embodiment of the gear pump and reservoir, generally shown at 10, having a pump housing 12 for a fluid sprayer of the present invention. The pump housing 12 has a mounting surface 14 for attaching the gear pump and reservoir 10 to a hand held appliance having a fluid spray. The pump housing 12 also has a recessed portion 16 which has a rigid conical projection 18 which is preferably centered and projects within the housing 12. The conical projection 18 has an orifice 20, which has fluid communication with a pump inlet 22. The pump housing 12 has a cavity 24 for receiving pump components, preferably on the opposite side of the housing 12 from the recessed portion 16. The cavity 24 has ribs 26 therein which form pump passages. These passages lead from the inlet 22 through a pump portion to a pump outlet 28.

A flexible fluid line 30 is connected to the pump outlet 28, which directs fluid from the outlet 28 to a sprayer head 32. A discharge check valve 34 is located adjacent, and immediately upstream, to the sprayer head 32. The check valve 34 may be a spring loaded ball valve or other type of check valve commonly known in the art. The purpose of the check valve 34 is to limit dribbling of fluid from the sprayer head 32. The check valve 34 generates a cracking pressure so that fluid entering into the sprayer head 32 has sufficient energy to drive the fluid through the sprayer head 32 and break the fluid up into fine droplets in preferably a fanshaped pattern.

The gear pump and reservoir 10 also has a fluid container 36 which serves as a reservoir of fluid to be sprayed by the sprayer head 32. The container 36 has a finish 38 to which a closure 40 is preferably removably attached but which may also be fixedly attached. The attachment of the closure 40 is preferably by a "bayonet" twist and lock system commonly known in the bottle art. Alternatively, the closure 40 may be threaded or even welded onto the finish 38. The closure 40 preferably has two openings 42 and 44. The opening 42 is an air vent opening which intersects a groove 46 and serves as a path for ambient air to reach the opening 42 when the gear pump and reservoir 10 are fully assembled. Inside the opening 42 is an elastomeric gasket 48 which compression seals the finish 38 to the closure 40. The gasket 48 has two inwardly facing slit valves 50 and 52, preferably molded as part of the gasket 48. The slit valve 50 is preferably smaller than the valve 52 and serves as an air vent valve to the fluid container 36. That is, as a fluid 54 is pumped from the container 36, ambient air is admitted through the vent valve 50 to replace the fluid 54 so that the container 36 does not collapse or generate a vacuum within the container 36.

The opening 44 is preferably centered in a closure 40 such that it is aligned with a conical projection 18. The slit valve 52 is located directly behind the opening 44 so that it too is aligned with the conical projection 18. The slit valve 52 serves as a fluid discharge valve such that the container 36 retains the fluid 54 until the fluid discharge valve 52 is opened by the conical projection 18 when the container 36 and the closure 40 are inserted into the recessed portion 16 and held there by a clamp (not shown) at the upper end of the container 36.

Figure 4:
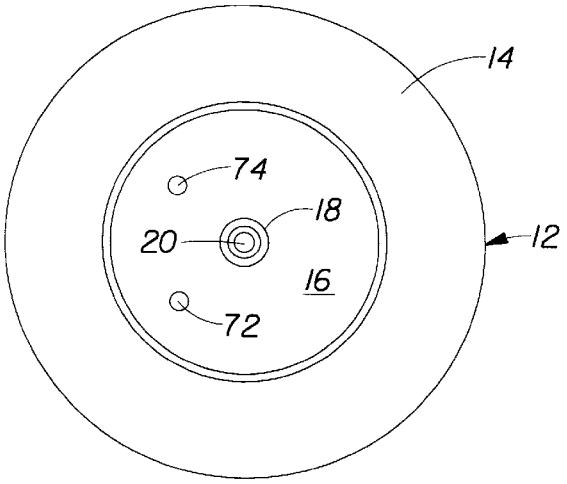
FIG. 4 is a top view of the pump housing of FIG. 1, showing a recessed portion for receiving the inverted container and fitment, and showing a conical projection for opening the slit valve when the inverted container is inserted into the recessed portion, as shown in FIG. 2.
Figure 5:
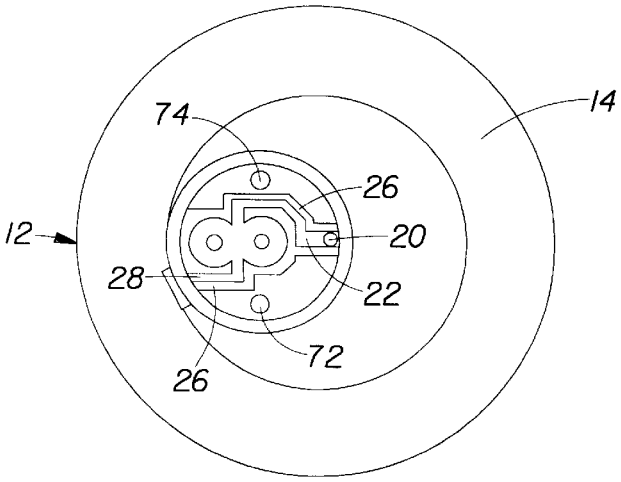
FIG. 5 is a bottom view of the pump housing of FIG. 1, showing a cavity for receiving a pair of gears and a drive motor to form the gear pump.
Figure 6:
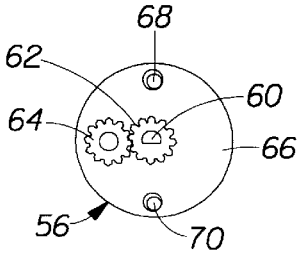
FIG. 6 is a top view of the pump motor of FIG. 1, showing the pair of gears, one of which is slidably mounted to the motor shaft.

The gear pump and reservoir 10 further include a drive motor 56. The drive motor 56 is a direct current electric motor, preferably supplied with electrical energy by dry cell batteries (not shown). The drive motor 56 has a motor housing 58 and a rotating shaft 60 extending from the motor housing 58. A pinion gear 62 is fixedly attached or slidably attached to the shaft 60 and is driven by a shaft 60. A similarly shaped and sized idler gear 64 is engaged with the pinion gear 62. The idler gear 64 preferably rotates freely about a pin 65 extending from the cavity 24 of the pump housing 12. A resilient fluid sealing member 66 is located between the motor housing 58 and gears 62 and 64, and forms a static seal with walls of the pump housing cavity 24 and a dynamic seal with the rotating shaft 60 when the drive motor 56 is inserted into the cavity 24 to form the gear pump. Preferably, the drive motor 56 is held in place within the cavity 24 by two screws (not shown), which are threaded into holes 68 and 70 in the motor housing 58, as shown in FIG. 6. These screws preferably extend from the pump housing 12 through clearance holes 72 and 74 located therein, as shown in FIGS. 4 and 5, and through the resilient member 66.

The drive motor 56 has two electrical connections 76 and 80 extending therefrom, to which is preferably connected in series an electrical circuit having four standard AA size batteries 82 and a user operated, normally open switch 84, such as a spring-loaded push button. When the switch 84 is closed, as shown in FIG. 2, a current flows through the drive motor 56, which rotates gears 62 and 64 and generates a pressure sufficient to open the check valve 34 and forces fluid through the sprayer head 32. The switch 84 and batteries 82 represent one means for powering and operating the preferred gear pump and reservoir 10. However, other alternatives may be used which are well known in the art, without deviating from the intent of the invention.

In a particularly preferred embodiment of the present invention, the container 36 is a 10 inch tall by 2.5 inch diameter bottle injection blown from high density polyethylene. The closure 40 is injection molded of polypropylene. The gasket 48 is injection molded of silicone rubber as are the slit valves 50 and 52. The pump housing 12 is injection molded of acetal, and the recessed portion 16 is approximately 0.5 inches deep and 1.3 inches in diameter. The gears 62 and 64 are also injection molded of acetal and are preferably 14 tooth gears which are 0.312 inches in diameter and 0.134 inches in thickness. The resilient member 66 is injection molded of ethylene propylene rubber, and like the motor 56, the member 66 is approximately 1 inch in diameter. The member 66 is approximately 0.3 inches thick. The motor 56 is preferably a 6 volt direct current motor, Model No. 53635-4040P-470, made by Sun Motor of Industrial, CO. The shaft 60 is 0.09 inches in diameter and has a "D" shape cross-section that is slidably attached to the driven gear 62. The shaft 60 preferably rotates at approximately 12,000 RPM under load and the gears 62 and 64 produce a flow rate of the fluid 54 of approximately 220 milliliters per minute at an outlet pressure of 24 psig. The input power is approximately 3 watts. The fluid 54 has a viscosity similar to water and preferably comprises water and a surfactant, such as a light duty peroxide solvent or an alcohol based solvent. The sprayer head 32 is preferably a Bowles Fluidic Nozzle, Model No. 3164P027, made by Bowles Fluidics Corporation of Columbia, Mo.

Although gear pumps are able to lift fluid from a container below them, gear pump precision and power determines the suction head available. In order to minimize precision and power, and therefore size and cost, the reservoir 36 of the present invention is preferably located directly above the gear pump so that a static head is always present to prime the pump, and no suction is required. Because of the continuous static head from the reservoir 36, the discharge check valve 34 ahead of the sprayer head 32 has a cracking pressure greater than the static head, so that no leakage occurs through an inactive pump of the sprayer head 32 as this leakage would contribute to fluid dribble from the sprayer head 32. The cracking pressure is preferably higher than the static head to the extent that fluid passing through the discharge check valve 34, when the pump operates, has sufficient pressure to cause the sprayer head 32 to produce a fine spray.

The conical projection 18 and slit valve 52 interface between the fluid container 36 and pump inlet 22 provide a short path for fluid to reach the pump from the reservoir. Thus, the static head in the reservoir is principally the height of fluid in the container 36. Removal of a depleted container 36 and replacement of a fresh container 36 occur with minimal fluid leakage because of the conical projection 18 and slit valve 52 interface.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A spray appliance, comprising:

an electric motor;

a gear pump driven by said electric motor;

a fluid reservoir in fluid communication with said gear pump and located above said gear pump so that a static head of fluid in said reservoir maintains said gear pump in a primed state; and a fluid line leading from said gear pump to a sprayer head, said fluid line having a discharge check valve located therein, said check valve having a cracking pressure higher than said static head of fluid so that fluid passes to said sprayer head only when said gear pump operates to increase pressure in said fluid line above said cracking pressure.

2. The spray appliance of claim 1, wherein said cracking pressure is between about 0.7 psig and about 5 psig.

3. A gear pump/reservoir device for a fluid sprayer, comprising:

a pump housing having a mounting surface for attachment to a hand held appliance and a recessed portion for receiving and sealing thereto a fluid reservoir, said pump housing also having a cavity for locating a drive motor and gears therein, said cavity having ribs therein forming pump passages including a pump inlet and a pump outlet said recessed portion having a projection therein, said projection having an orifice therethrough extending into said pump inlet;

an electric motor having a motor housing and a rotating shaft extending therefrom, said motor housing connected to said pump housing via a resilient fluid sealing member located therebetween;

a pinion gear mounted to said rotating shaft of said motor inside said cavity of said pump housing;

an idler gear rotatably connected within said cavity to engage said pinion gear, said gears together with said pump passages in said cavity substantially limiting fluid flow between mating gear teeth of said gears and between said gears and said cavity, to form a gear pump, said pump outlet being in fluid communication with said gear pump;

a fluid line leading from said pump outlet to a sprayer head, said fluid line having a discharge check valve located therein to minimize fluid dribbling at said sprayer head, said check valve having a cracking pressure;

a fluid container mounted to said recessed portion of said pump housing to form a fluid reservoir, said container having an air vent valve to enable ambient air to replace fluid drawn from said reservoir and a fluid discharge valve, said fluid discharge valve being opened by engagement with said projection within said recessed portion to provide fluid communication to said pump inlet; and means for powering and operating said motor such that said gear pump provides a continuous flow of fluid to said sprayer head upon demand by a user.

4. The device of claim 3, wherein said cracking pressure ranges from 0.7 to 5.0 psig.

5. The device of claim 3, wherein said motor is a direct current motor and said means for powering is four size AA batteries wired to said motor in series with an on-off switch, said means for operating said motor being manually controlled.

6. The device of claim 3, wherein said fluid container is replaceable in said recessed portion of said pump housing.

7. The device of claim 3, wherein said fluid container is located above said gear pump so that a static head of fluid in said reservoir maintains said gear pump in a primed state.

8. The device of claim 7, wherein said cracking pressure of said discharge check valve exceeds said static head of fluid in said reservoir.

9. The device of claim 3, wherein said projection is conical.

10. The device of claim 3, wherein said projection is at least one of rigid and centered within said recessed portion.

11. The spray appliance of claim 1, further comprising a mounting surface having a recessed portion for receiving said fluid reservoir.

12. The spray appliance of claim 11, wherein said gear pump and said electric motor are disposed opposite said recessed portion of said mounting surface.

13. The spray appliance of claim 1, wherein said fluid reservoir contains a liquid comprising a surfactant.

14. The spray appliance of claim 11, wherein said recessed portion has a projection therein with an orifice which communicates with an inlet of said gear pump for delivering the fluid to said gear pump.

* * * * *